US006490762B1

(12) United States Patent
Siegenthaler et al.

(10) Patent No.: US 6,490,762 B1
(45) Date of Patent: Dec. 10, 2002

(54) WINDING DEVICE

(76) Inventors: Marcel Siegenthaler, Im Grund 10, Ch-8424, Embrach (CH); Christian Sporri, Im Gugi 2, CH-8457, Humlikon (CH); Werner Graber, Rebackerstrasse 22, CH-8810, Horgen (CH)

( * ) Notice: Subject to any disclaimer, the term of this patent is extended or adjusted under 35 U.S.C. 154(b) by 0 days.

(21) Appl. No.: 08/860,408

(22) PCT Filed: Oct. 18, 1996

(86) PCT No.: PCT/CH96/00366

§ 371 (c)(1),
(2), (4) Date: May 4, 1998

(87) PCT Pub. No.: WO97/15707

PCT Pub. Date: May 1, 1997

(30) Foreign Application Priority Data

Oct. 23, 1995 (DE) ..... 195 39 365

(51) Int. Cl.[7] ..... D04H 1/00
(52) U.S. Cl. ..... 19/161.1; 242/541.3
(58) Field of Search ..... 19/64.5, 65 A, 19/149, 161.1, 115 R, 296, 298, 299, 300; 242/541.3, 535.4

(56) References Cited

U.S. PATENT DOCUMENTS 546,009 A * 9/1895 Graves ..... 242/541.3
3,957,220 A * 5/1976 Beck et al. ..... 242/541.3
4,069,989 A * 1/1978 Pfeifer et al. ..... 242/541.3
4,146,188 A * 3/1979 Hewinson et al. ..... 242/541.3
5,058,820 A * 10/1991 Ito et al. ..... 242/541.3
5,832,696 A * 11/1998 Nagy et al. ..... 242/541.3

* cited by examiner

*Primary Examiner*—Danny Worrell
*Assistant Examiner*—Gary L. Welch
(74) *Attorney, Agent, or Firm*—Francis C. Hand, Esq.; Carella, Byrne et al.

(57) ABSTRACT

In a lap winding apparatus for producing a batt lap, the batt is wound onto a tube which is rotatable about a fixed axis and is driven by a revolving endless belt. The belt is arranged in a loop, formed between two deflecting rolls and is tensioned by a tensioning device. The tube which is rotatable about a fixed axis, as well as the two deflecting rolls are dimensioned, and positioned relative to each other, in such a manner that the loop at the beginning of the lap winding process embraces the tube over an initial minimum wrapping angle equal to, or larger than, 120° and preferentially equal to, or larger than, 180°. For generating a tensioning force depending on the lap diameter, the tensioning device is associated with a control device.

28 Claims, 6 Drawing Sheets

WINDING DEVICE

Figure 1:
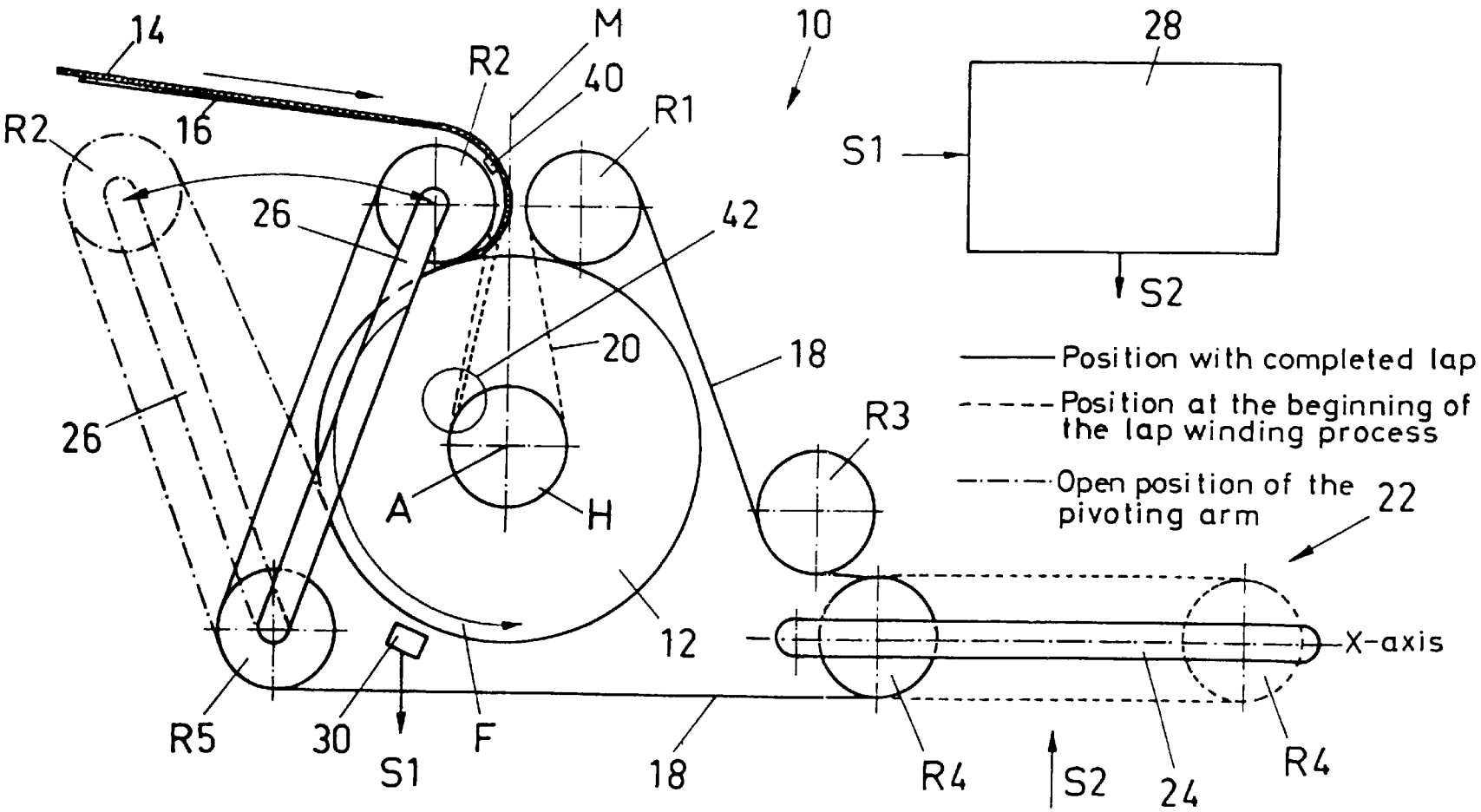

The present invention concerns a lap winding apparatus for producing a in which a batt is wound onto a core which is rotatable about a fixed axle.

In a lap winding apparatus is known from GB 329 871 in which an endless belt is driven over two deflecting rolls and the core to form a loop that is tensioned by a tensioning arrangement. The belt, at the beginning of the lap winding process, contacts a small portion of the core circumference. The wrapping angle is less than 600. Tensioning of the belt is effected by means of an angled lever at one arm of which a deflecting roll embraced by the belt is provided and at the other arm of which a weight is provided which for setting the tensioning force can be adjusted manually.

In this known lap winding apparatus, a kind of pulling effect can occur due to the local strain affecting the baft, which causes the lap layers to be shifted against each other. Due to the friction, felting of the baft can occur, which causes problems, impairing product quality, as the lap unrolls.

It thus is the goal of the present invention to create a lap winding apparatus of the above mentioned type which is simple in lay-out and which permits production of high quality taps which can be unrolled without problem.

This goal according to the invention is achieved in that the core is rotatable about a fixed axis and the two deflecting rolls are dimensioned and positioned in such a manner that the belt loop at the beginning of the lap winding process embraces the core over an initial minimum wrapping angle of 120° or larger and preferably of 180° or larger and that the tensioning device for generating a tensioning force depending on the lap diameter is associated with a control device.

Since the rotatable core is, at the beginning of the lap winding process being surrounded over a large area by the belt, i.e. over a larger wrapping angle, the lap being formed from the beginning is put under a much more even pressure. Furthermore any possible formation of an oval shape of the lap can be effectively counteracted by correspondingly adapting the tensioning force to the current lap diameter. The fixed axis of the core notwithstanding, occurrence of a pulling effect can be virtually excluded. In this arrangement, shifting of the batt layers against each other and felting of the batt is prevented. Thus, a high quality lap is produced which can be unrolled without problems in subsequent processing of the baft.

Particularly in view of negligible formation of blisters and of further improved unrolling properties, it proves advantageous if the tensioning device is controlled by the control device in such a manner that the tensioning force diminishes as the lap diameter increases until a predeterminable lap size is reached. In this process the tensioning force preferentially diminishes linearly as the lap diameter increases until a pre-determinable lap size is reached. Owing to the harder pressure applied in lap winding during the beginning stages, plasticity of the of the lap is reduced and the lap gains more stability in itself which positively influences the unrolling properties as well as the quality.

A further advantage is gained if the pre-determinable lap size is chosen smaller than the final lap size and if the tensioning force is maintained constant until the predeterminable lap size is reached. In this process, it is provided preferentially that while the lap diameter increases, the tensioning force is reduced over the major part of the lap winding process and that only towards the end of the lap winding process is maintained constant at a value above zero until the final lap size is reached.

The control device, which preferentially is an electronic control device, can be associated with a sensor which scans the lap diameter directly. In principle it also is possible to provide a measuring device which monitors the baft length fed to the lap winding apparatus in order to obtain a signal representative of the lap diameter for the control device.

In a preferred embodiment of the present invention, the tensioning device comprises a tensioning roll associated with a linear guide arrangement. In this arrangement, the belt is tensioned in a plane parallel to the plane containing the axes of the two deflecting rolls between which the belt loop forms. Particularly, if control of the tensioning force is to be effected as precisely as possible,. it also proves advantageous if the belt embraces the tensioning roll, independently of the position of the latter, always over a wrapping angle of 180°. In this case, the two belt sections facing each other extend mutually parallel in the area of the tensioning roll, which permits, among other advantages, more precision in the control of the tensioning force. Adjustment of the position of the tensioning roll can be effected using an electric, hydraulic or pneumatic drive associated with the control device, the drive appropriately comprising a cylinder/piston unit.

The belt expediently is driven via at least one of the deflecting rolls. For controlling the belt drive speed in an open loop or closed loop control system, the belt drive can be associated with the control device. The belt drive speed can be varied in function of the lap diameter and can e.g. decrease as the lap diameter increases. The open or closed loop control system can be laid out in such a manner that the belt drive speed at the beginning of any lap winding process is increased from zero to a predetermined value. The belt drive can be frequency controlled using an invertor or similar devices. It also can be imagined that the belt drive speed be maintained constant at least temporarily.

If the core is formed by a tube, this tube can be placed e.g. on an extension each on the two lap disks facing each other between which the tube preferentially is clamped.

The two deflecting rolls, between which the belt loop forms, for ejecting the lap can be preferentially moved apart relative to each other while simultaneously the belt is tensioned.

According to a particularly advantageous embodiment of the invention removal of at least one of the lap discs, effected e.g. by extending, traversing or similar movements, ejection of the lap, transfer of the lap to a transporting device or similar steps and/or inserting and clamping of a new empty tube is automated at least partially and again is controlled by means of the control device.

In order to avoid electrostatic charges, the belt is made of a Kevlar material.

The lap winding apparatus is applicable in particular in combing where a baft or web e.g. delivered by a drafting system via deflecting plates, via calendar rolls and/or via similar elements is taken up. The completed lap subsequently is fed to a combing machine.

Figure 3:
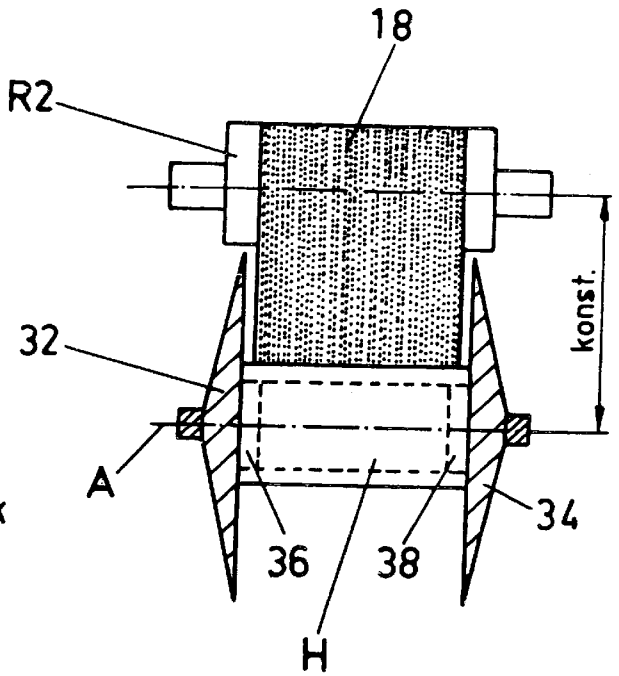
Figure 2:
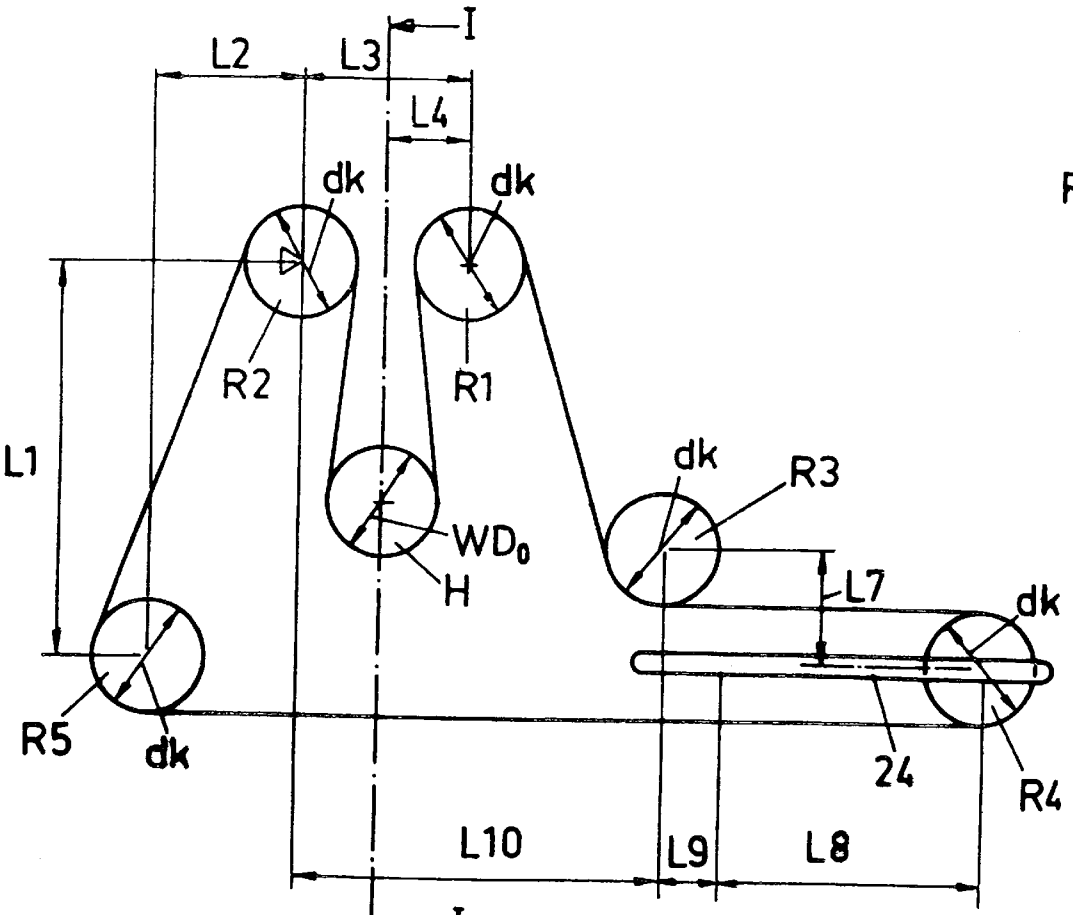
Figure 4:
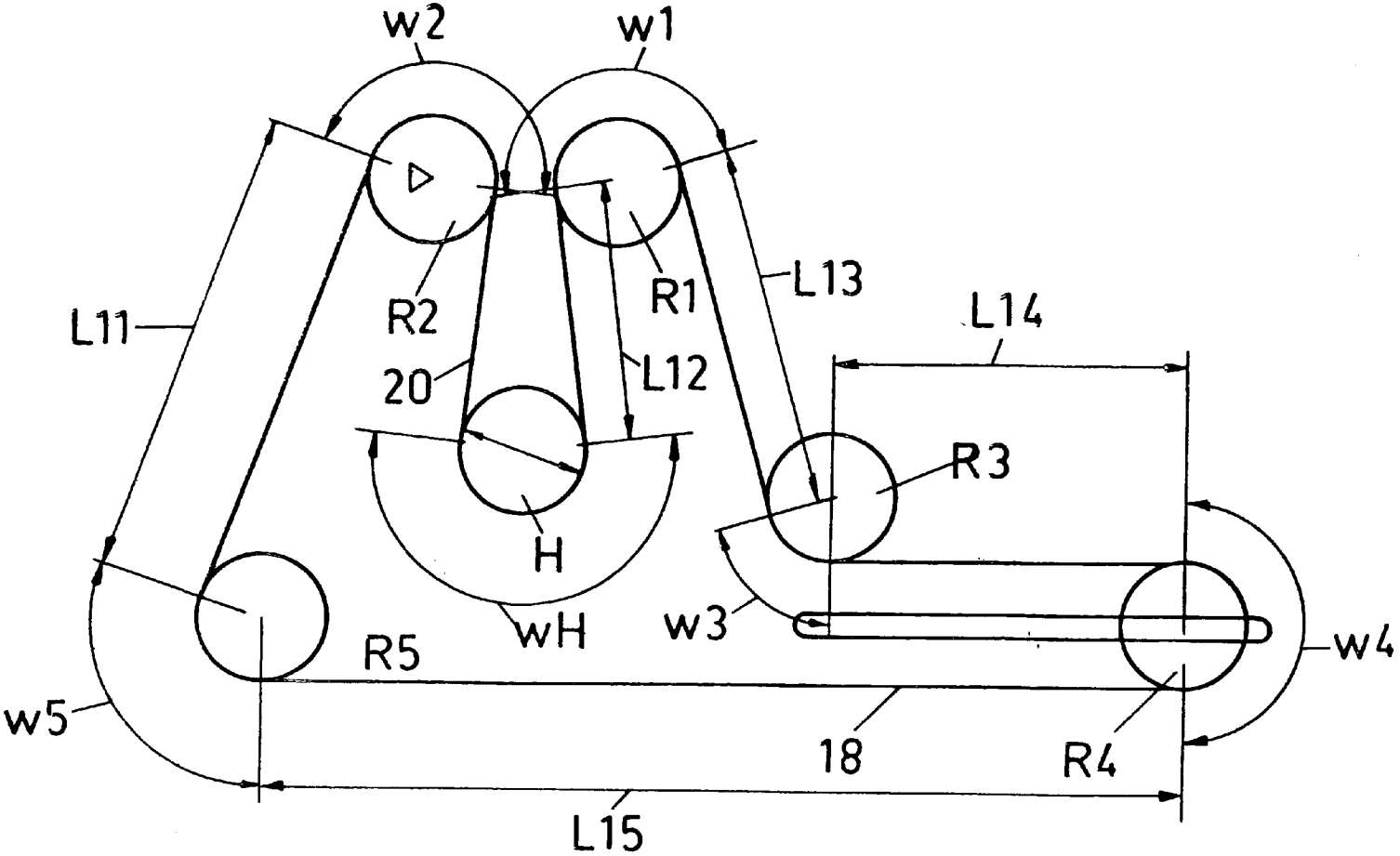
Figure 6:
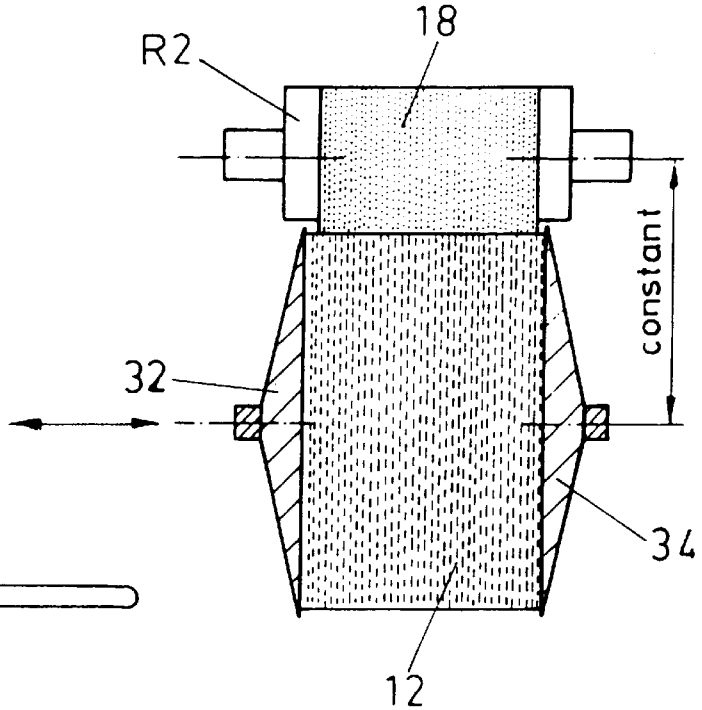
Figure 5:
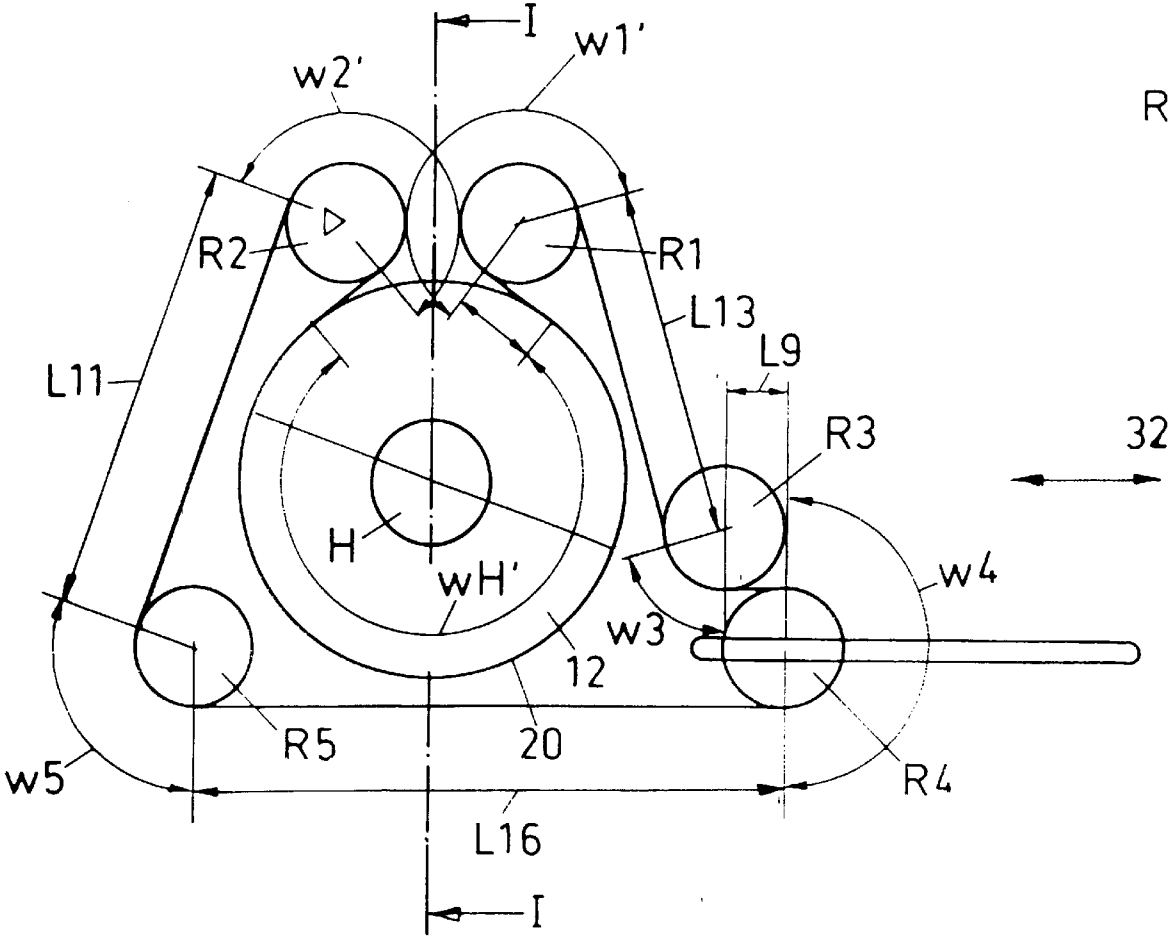
Figure 7:
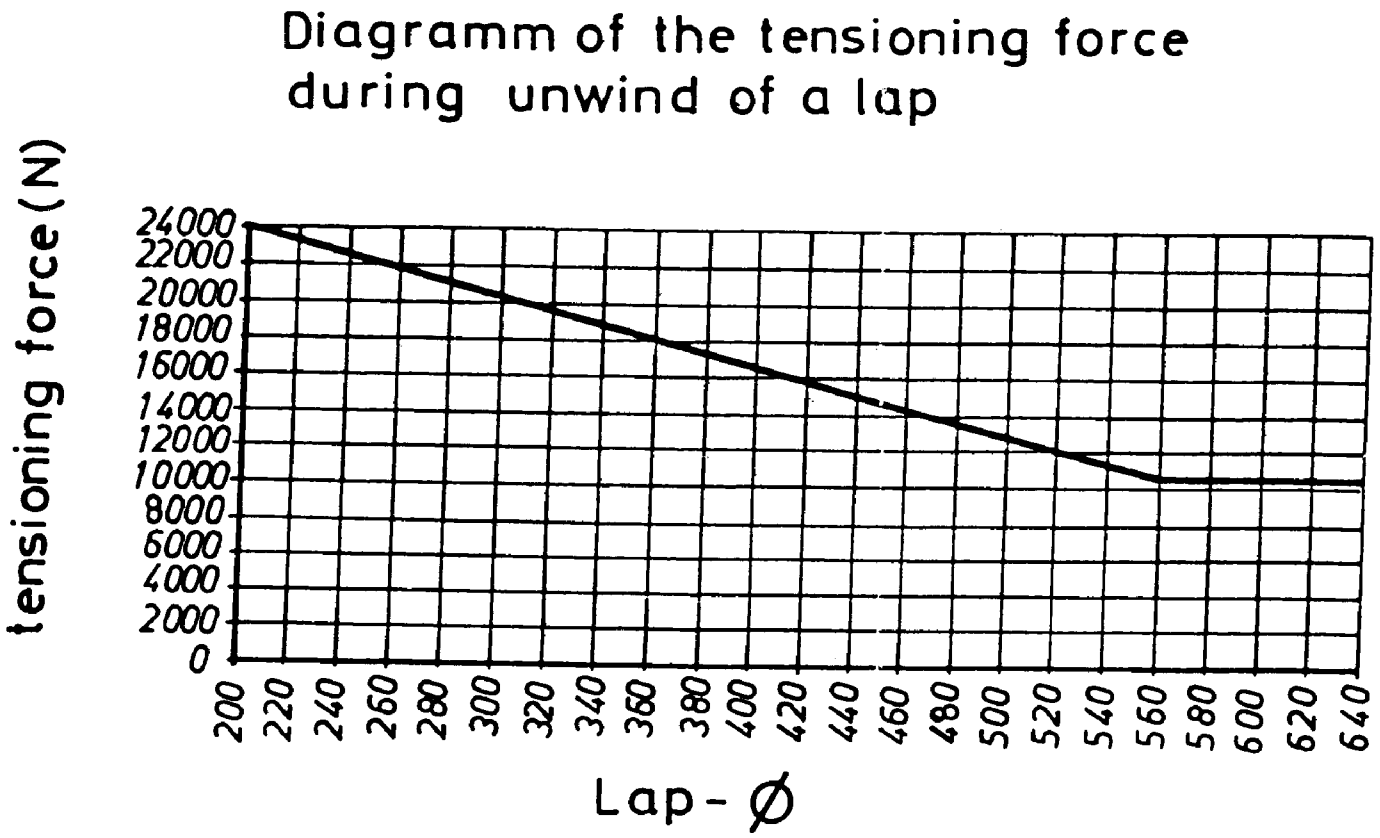

The present invention is described in more detail in the following with reference to design examples illustrated in the drawings. It is shown in:

FIG. 1 illustrates a schematic view of the basic lay-out of a lap winding apparatus, shown in the beginning phase of the lap winding process as well as in the end phase of the lap winding phase, FIG. 2 illustrates a simplified view of the lap winding apparatus according to the FIG. 1 at the beginning phase of the lap build, FIG. 3 illustrates a partial section along the line I—I according to the FIG. 2, FIG. 4 illustrates a view corresponding to the one shown in the FIG. 2 the wrapping angles being indicated, FIG. 5 illustrates a simplified view of the lap winding apparatus according to the FIG. 1 in the end phase of the lap build, FIG. 6 illustrates a partial section along the line I—I according to the FIG. 5, and FIG. 7 illustrates the graph of the tensioning force in function of the lap diameter.

Figure 8:
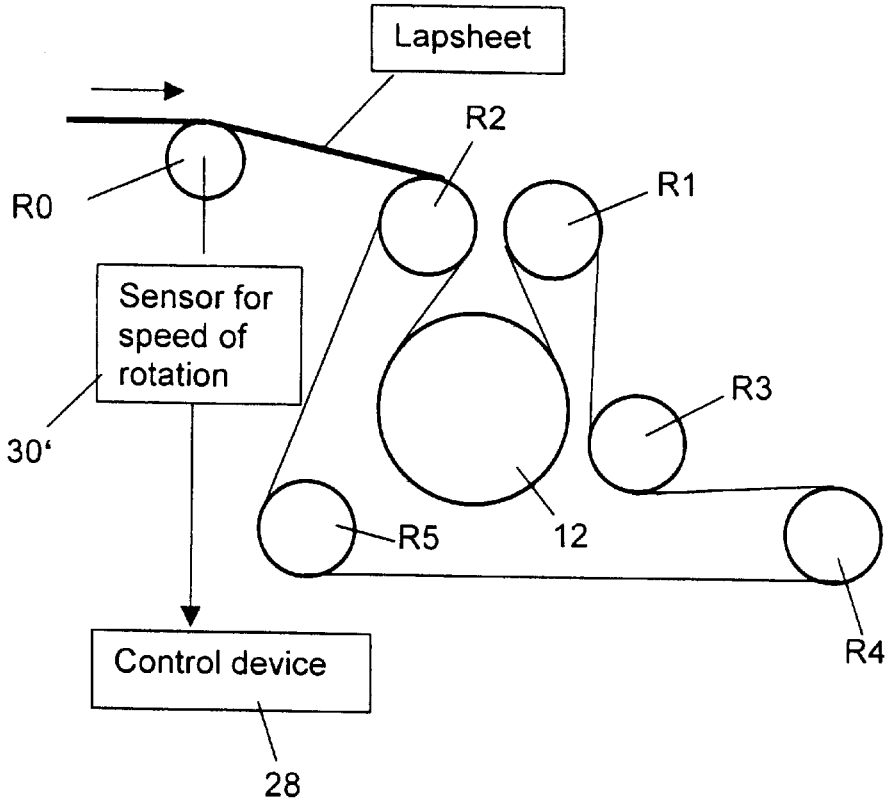
Figure 9:
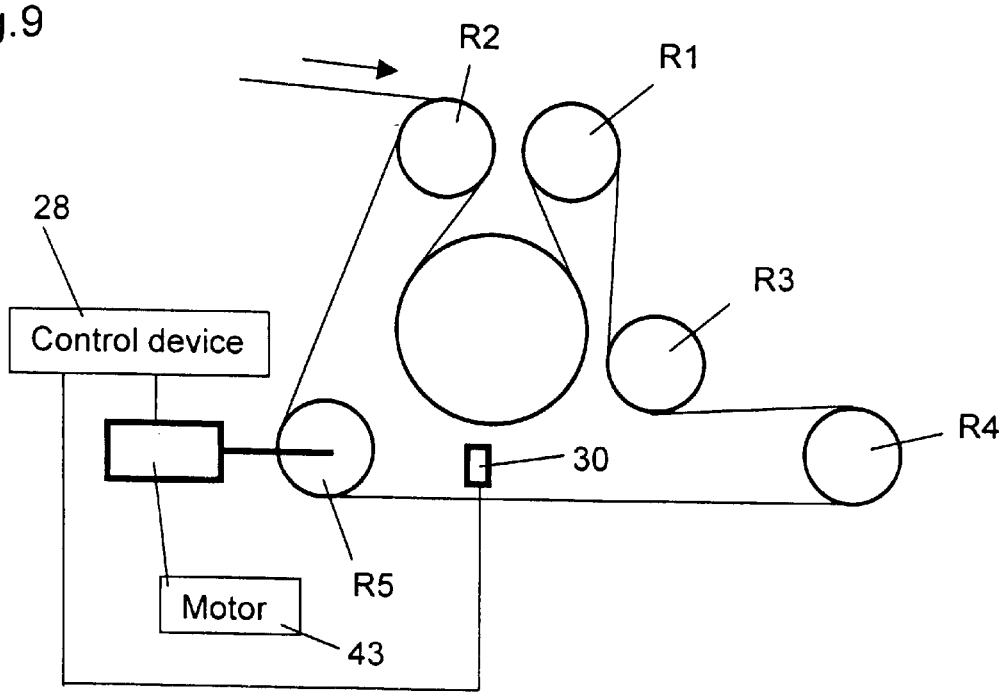

FIG. 8 illustrates a measuring device for measuring the batt length and supplying a signal to a control device in accordance with the invention; and FIG. 9 illustrates a modified apparatus having a control device to control a speed of a deflecting roll in accordance with the invention.

In FIG. 1, a lap winding apparatus 10 for producing a lap 12 is shown schematically. In principle, a winding apparatus 10 of this type can be used for rolling up a web, a fleece or a baft into a lap before the fiber material is subject to a further processing step. Thus, the winding apparatus can be used e.g. in combing for taking up a web supplied by a drafting system via guide plates, calendar rolls or similar elements, the lap produced subsequently being fed to a combing machine. In the following, the material supplied, for the sake of simplicity of the description, is referred to as bait, which, however, is not to be understood in a restricting sense.

A batt 14 is supplied to the lap winding apparatus 10 via a batt supply 16 which in the present case is formed by a plate curved at its downstream end.

The batt 14 is wound onto a tube H serving as a core which is supported rotatable about a fixed axis A. This tube H is driven by a revolving endless belt 18 which forms a loop 20 extending between two deflecting rolls R1 and R2, the tube H being taken up in the loop 20.

In the present case, the lap 12 is driven clockwise by the belt 18 as indicated by the arrow F. The loop 20 of the belt 18 embracing the lap 12 increases in length as the lap 12 builds up the belt 18 being tensioned during the entire lap winding process by a tensioning device 22. This tensioning device 22 comprises a tensioning roll R4 associated with a linear guide arrangement 24.

The belt 18 is guided by further deflecting rolls R3 and R5 and by the tensioning roll R4 the position of which can be adjusted along the linear guide arrangement 24 in a plane extending parallel to the plane containing the axes of the two deflecting rolls R1 and R2. In FIG. 1, the axis along which the tensioning roll R4 can be adjusted is designated as x axis.

In the design example illustrated in FIG. 1, the deflecting rolls R1, R2, R3 and R5, the tensioning roll R4 and the tube H all are of the same outside diameter H. The axes of the rolls and of the tube H are mutually parallel. The deflecting roll R1 and R2 situated in the upper part of the apparatus are arranged at a vertical distance from a further deflecting roll R5 which distance exceeds the maximum diameter of the lap 12.

The two deflecting rolls R1 and R2 on one hand and the deflecting roll R5 on the other hand have their axes contained in a horizontal plane each. In the position of the rolls, indicated with solid lines, in which during the end phase of the lap winding process the tensioning roll R4 has reached its end position shown at the left hand side and the deflecting roll R2 has not yet been pivoted outwards (the positions of the deflecting rolls R1, R3 and R5 being stationary), the lower deflecting roll R5 shown at the lower left with respect to the upper deflecting roll R2 shown at the left is offset towards the left hand side. The tensioning roll R4 in its end position during the end phase of the lap winding process shown in FIG. 1 with solid lines is offset with respect to the upper deflecting roll R1 towards the right hand side, the horizontal distance between these rolls R1 and R4 being larger than the one between the rolls R2 and R5. Thus, the rolls R1, R2, R4 and R5 are arranged in a trapezoid pattern the horizontal distance between the rolls R4 and R5 exceeding the one between the rolls R1 and R2.

The tensioning roll R4 in its position indicated in FIG. 1 with solid lines corresponds to its end position. From this end position of the tensioning roll R4 shown on the left hand side, the further deflecting roll R3 arranged above ills offset towards the left by a distance, which measured from roll center to roll center corresponds about to the radius of the rolls R1 through R5 which all are of the same diameter. The vertical distance between the rolls R3 and R4 measured center to center corresponds about to the roll diameter. This arrangement ensures that the belt 18 contacts the tensioning roll R4 over a wrapping angle of 1800 always, independently of the roll position.

The belt 18 is driven e.g. via the lower deflecting roll R5 shown at the lower left in the plane in which the belt 18 is tensioned.

The upper left deflecting roll R2 is arranged at the upper end of a pivoting arm 26 which at its other end is supported rotatable about the axis of the left lower deflecting roll R5. In FIG. 1, the pivoting arm 26 is shown with dash-dotted lines in its position pivoted to the left hand side, in which position the completed lap 12 is ejected. The tube H arranged rotatable about the fixed axis A and the two deflecting rolls R1 and R2 are dimensioned in such a manner, and in the working position in which the pivoting arm 26 is pivoted towards the right, are arranged in relation to each other in such a manner that the loop formed by the belt 18 between the deflecting rolls R1 and R2 at the beginning of the lap winding process embraces the tube H over a minimum initial wrapping angle which preferentially equals, or exceeds, 120° and in particular equals, or exceeds, 180°, and in the present case equals about 180°. This lay-out of the loop at the beginfling of the lap winding process is indicated with dotted lines in FIG. 1. In this phase of the process, the tensioning roll R4 is located in its end position shown at the right hand side. During the winding process the wrapping angle over which the belt loop 20 embraces the tube H increases. The tensioning roll R4 is shifted towards the left hand side until upon completion of the build-up of the lap 12 it reaches its other end position shown with solid lines at the left hand side.

The positions of the two upper deflecting rolls R1 and R2 can be adjusted in all directions for setting the lap winding apparatus before bringing it into service. The deflecting roll R3 is bevelled and its position can be adjusted in lateral directions. The deflecting roll R5 which serves as drive roll is not bevelled and can not be adjusted. The drive in particular can be effected via a clutch or via a reduction gear. The associated motor can be frequency controlled.

The tensioning device 22 for generating a tensioning force in function of the lap diameter is preferentially an electronic control device 28. In the design example illustrated in FIG. 1, a sensor 30' is provided to directly scan the lap diameter which supplies a corresponding signal SI to the control device 28. However, instead of the sensor 30, a measuring device measuring the batt length fed in could be associated with the control device 28 for supplying the control device with a signal representative of the lap diameter.

For example, as shown in FIG. 8, wherein like reference characters indicate like parts as above, a sensor of 30' is provided for sensing the speed rotation of a lap roll RO and delivering a corresponding signal to the control device 28. Measuring the speed of rotation of the roll RO in view of the diameter of the roll RO, the length of the lap is determined.

In another embodiment, as illustrated in FIG. 9, wherein like reference characters indicate like parts as above, a motor 43 is provided for driving the lower deflecting roll R5 and the control device 28 is connected to the drive motor 43 to control the speed of the deflecting roll R5 in order to control the speed of the winding process.

Adjustment of the position of the tensioning roll R4 along the linear guide arrangement 24 controlled via the control device 28 can be effected using e.g. an electrical, hydraulic or pneumatic drive. This drive can comprise e.g. a cylinder/piston unit.

Also, the belt drive effected e.g. via the deflecting roll R5 can be controlled via the control device 28 using an open loop or closed loop control system which can be implemented using e.g. a frequency-controlled invertor or a similar device.

The tube H appropriately is clamped between two lap discs 32, 34 (comp. FIGS. 3 and 6) which can be removed laterally in the direction of the horizontal arrow shown in FIG. 6. These lap discs also can be pivotable outwardly. As illustrated in particular in FIG. 3, the lap discs 32, 34 are provided with extensions 36, 38 onto which the tube H can be donned.

Also, removal of the lap discs 32, 34, ejection of the lap 12 effected by pivoting outwardly the pivoting arm 26, transfer of the lap to a transporting device or similar devices and/or insertion and clamping of an empty new tube H can be automated at least partially and can be controlled by the preferably electronic control device 28.

In the outlet area of the batt supply element 16, a banana-shaped guide element 40 formed like a tensioned bow is provided which determines the width of the batt fed in. The bait supply element 16 designed as a batt infeed plate can be provided with a lateral guide element also.

In FIG. 2, a simplified view of the lap winding apparatus 10 illustrated in FIG. 1 is shown at the beginning of the winding process during which phase the tensioning roll R4 is in its end position shown at the Right hand side. According to this FIG. 2 dimensions and positions of rolls relative to each other are given for one design example the values cited, however, are not to be understood in a restricting sense.

In the design example illustrated in FIG. 2 dk designates the diameters of the deflecting rolls R1, R2, R3 and R5 as well as of the tensioning roll R4. The diameter of the lap at the beginning of the winding operation corresponds to a value WDO i.e. to the diameter of the tube H. The diameter dk of the deflecting rolls Hi, R2, R3 and R5 and the initial lap diameter WDO and the tube diameter in this design example are equal and are dimensioned as follows:

dk=200 mm

WDO=200 mm

In FIG. 2, L1 designates the vertical distance between the deflecting rolls R2 and R5 measured from roll center to roll center. L2 designates the horizontal distance between the deflecting rolls R2 and R5 measured center to center. L3 designates the corresponding horizontal distance between the deflecting rolls R1 and R2. L4 designates the horizontal distance between the center line between the deflecting rolls R1 and R2 line extending through the center of the tube H and the center of the deflecting roll R1. L7 designates the vertical distance between the centers of the deflecting roll R3 and the tensioning roll R4. L8 designates the shifting distance over which the tensioning roll R4 is moved along the linear guide arrangement 24. L9 designates the horizontal distance, measured center to center, between the deflecting roll R3 and the tensioning roll R4 located in its end position shown at the left hand side (as shown in the FIG. 5). L10 designates the distance between the two deflecting rolls R2 and R3 measured center to center. In the present design example, these distances are of the following values:

L1≈700 mm;

L2≈260 mm;

L3≈300 mm;

L4≈150 mm;

L7≈200 mm;

L8≈455 mm;

L9≈100 mm;

L10≈650 mm.

In FIG. 3, the two lap discs 32, 34 are shown between which the tube H is clamped. In this arrangement, the tube is donned onto the extensions 36, 38 provided on the lap discs 32, 34. The vertical distance between the upper deflecting rolls R1 and R2 and the tube H remains constant as indicated by the vertical arrow. In this FIG. 3 also the section of the belt 18 extending from the deflecting roll R2 to the tube H is shown. The process phase shown is the phase of the beginning of the lap winding process during which no lap has been built up yet on the tube H.

In FIG. 4, the same roll arrangement is shown as in FIG. 2, but with the wrapping angles which extending over the respective rolls and the lengths L1 of the free belt sections extending between the rolls being indicated. In this arrangement, wi designates the wrapping angle over which the belt 18 embraces the corresponding roll or the tube H. The corresponding values in the present design example are listed as follows:

w1≈171°;

w2≈167°;

w3≈74°;

w4≈180°;

w5≈110°;

wH≈194°.

In the case illustrated, the loop 20 at the beginning of the lap winding process initially embraces the tube H over a wrapping angle wH of about 194°; the initial lap diameter WD0 being 200 mm corresponding to 0 (zero) batt layers and thus to the tube diameter.

L11 designates the length of the belt section extending freely between the deflecting rolls R2 and R5. L12 designates the length of the belt section extending freely between the deflecting roll R1 and the tube H. A corresponding length also prevails between the deflecting roll R2 and the tube H as the axis of the tube H is located in the center plane between the two deflecting rolls R1 and R2. L13 designates the length of the belt section extending freely between the deflecting rolls R1 and R3. L14 designates the length of the belt section extending freely between the deflecting roll R3 and the tensioning roll R4. L15 finally designates the length of the belt section extending freely between the tensioning roll R4 and the deflecting roll R5. in the present design example these lengths are of the following values:

L11≈747 mm;

L12≈403 mm;

L13≈577 mm;

L14≈555 mm;

L15≈1'465 mm.

As the wrapping angle w4 in the area of the tensioning roll R4 is always 180° independently of the position of the roll R4 the two belt sections facing each other of the length L14, and L15 respectively, always extend mutually parallel.

In FIG. 5, a simplified view, comparable to FIG. 4, of the lap winding apparatus is shown in which arrangement, however, the end phase of the lap winding process is illustrated, i.e. the tensioning roll R4 has reached its end position shown at the left hand side. In this arrangement, the wrapping angles w3, w4 and w5 in the area of the deflecting roll H3, the tensioning roll R4 and the deflecting roll R5 have not changed with respect to the phase at the beginning of the lap winding process.

But the wrapping angle wH', over which the belt loop 20 embraces the tube H, now is about 282°.

The wrapping angle w1' in the a area of the deflecting roll R1 now is about 215 g. In the area of the deflecting roll R2 the wrapping angle w2' now is about 211°. The length L9 of the belt section freely extending between the deflecting roll R3 and the tensioning roll R4 is of 100 mm, which thus corresponds to the radius of these two rolls, and which is equal to the radius of any one of the other deflecting roll s and of the tensioning roll R4 as well as the one of the tube H. The length L16 of the belt section freely extending between the tensioning roll R4 and the deflecting roll R5 is of 1010 mm. The lengths Lii and L13 of the belt sections freely extending between the deflecting rolls R2 and R5, and between the deflecting rolls R1 and R3, respectively, remain unchanged.

From FIG. 6, it can be seen that the lap winding process now is completed. The diameter of the lap 12 now almost equals the diameter of the lap discs 32, 34. The lap discs now can be removed as indicated by the horizontal arrow.

In the design example described above, the total belt length was of 5720 mm. The belt applied can be designed e.g. as an endless belt wound from aramid or Kevlar material or e.g. as a belt made from polyamide or similar materials, the ends of which are butted against each other.

In the preferred embodiment of the present invention, the tensioning device 24 is influenced by the control device 28 in such a manner that the tensioning force decreases as the lap diameter increases until a pre-setable lap size is reached. This decrease in tensioning force preferentially is linear as indicted in FIG. 7 where the graph of the tensioning force is plotted over the lap diameter. From this FIG. 7, it also can be seen that in the preferred design example, after the pre-set lap size, which in the present case is about 560 mm, has been reached, the tensioning force is maintained constant until the final lap size is reached.

According to FIG. 7, the tensioning force applied initially at the beginning of the lap winding process is about 24,000 N while the initial lap diameter is 200 mm. This tensioning force thereupon decreases linearly to about 10,000 N as the lap diameter has reached about 560 mm. Subsequently, the tensioning force is maintained constant until the final lap size is reached.

Owing to this adjustment, the formation of blisters is minimized and the unrolling properties of the lap are improved. Owing to the initially harder winding action under a higher force, plasticity of the lap is reduced and the lap structure in itself is rendered more stable which positively influences the unrolling properties of the lap as well as the quality of the product.

As can be seen from FIG. 5, the completed lap 12 is situated within the area defined by the deflecting rolls R1 through R3 and R5 as well as the tensioning roll R4. After the lap discs 32, 34 have been e.g. shifted, moved out, pivoted out and/or removed in similar manner, thus setting the lap free, the deflecting roll R2 is to be pivoted out by the pivoting arm 26 into the position indicated in FIG. 1 with dash-dotted lines in order to permit ejection of the lap. Ejection is effected by tensioning the belt 18 simultaneously with the pivoting motion of the pivoting arm 26. As the two upper deflecting rolls R1 and R2 now are moved apart from each other, the lap 12 can be taken off upwardly without obstruction.

In principle, another arrangement of the rolls can be chosen in which the lap is not taken off upwardly but is taken off, according to the illustration in FIG. 1, towards the left or towards the right. If this is desired, the arrangement shown in FIG. 1 is to be rotated by 90° in the plane of the drawing. In principle, it also can be imagined that the lap is taken off downward.

According to FIG. 1, the batt 14 is fed in via the batt feed guide 16 from the left hand side into the area 42 between the belt 18 and the tube H, i.e. on the side opposite the linear guide arrangement 24. In principle, it also can be imagined that the batt 14 is fed in on the same side on which the linear guide arrangement is located. In this arrangement, however, the sense of rotation of the belt drive is to be reversed in such a manner that the batt is taken in into the gap between the belt 18 and the tube H.

In FIG. 1, the control signal S2 indicates that the tensioning device 22 for controlling the tensioning force in function of the lap diameter, using an open loop or a closed loop system, is influenced by the control device 28. The belt drive speed also preferentially is controlled via the control device 28 in an open loop or a closed loop control system. Also, the belt drive speed again can be varied in function of the lap diameter. At the beginning of each lap winding process, preferentially a relatively fast increase of the drive speed up to a predetermined value can be effected. The belt drive preferentially effected via the deflecting roll R5 furthermore can be controlled in such a manner that at least over a certain time period it decreases as the lap diameter increases. In principle, however, also a belt drive is possible in which the drive speed is maintained constant at least over a certain period of time.

In principle, the belt drive can also be effected via a deflecting roll other than the roll R5 or by a plurality of rolls or in any other suitable manner. The open loop or closed loop control of the belt drive speed in this case is also effected preferentially via the control device 28 which advantageously also controls the automatic removal of the lap discs 32, 34, the automatic ejection of the lap 12 effected by pivoting the pivoting arm 26, the automatic transfer of the lap 12 to a transporting device, or to a similar device and/or the automatic insertion and clamping of an empty new tube H. In principle, automation of the start-up of the winding process, controlled via the control device 28, can be imagined

What is claimed is:

1. A lap winding apparatus comprising a core rotatably mounted on a fixed axis for winding of a lap thereon;

a pair of rotatable deflecting rolls parallel to said core;

an endless belt guided over said rolls and said core for driving said rolls and said core, said belt forming a loop between said rolls and about said core to effect winding of a lap onto said core;

a tensioning roll having said belt looped thereover, and a linear guide arrangement for moving said tensioning roll in a rectilinear path between an extended position relative to said core and a retracted position relative to said core, said extended position corresponding to an initial position of said core without a lap thereon and said retracted position corresponding to a position of said core with a lap wound thereon.

2. A lap winding apparatus as set forth in claim 1 wherein each said deflecting roll has an axis of rotation disposed in a plane parallel to said rectilinear path of said tensioning roll.

3. A lap winding apparatus as set forth in claim 1 wherein said core, each said deflecting roll and said tensioning roll have an equal outside diameter.

4. A lap winding apparatus as set forth in claim 1 which further comprises a third deflecting roll rotatably mounted on a fixed axis and having said belt looped thereover in driving relation, and a pivoting arm pivotally connected to and between said third deflecting roll and one of said pair of deflecting rolls to pivot said one of said pair of deflecting rolls away from the other of said pair of deflecting rolls to permit removal of said core with a lap wound thereon from between said pair of deflecting rolls.

5. A lap winding apparatus as set forth in claim 1 wherein said belt forms an initial wrapping angle about said core of at least 120°.

6. A lap winding apparatus as set forth in claim 1 further comprising a pair of discs for receiving said core therebetween, each disc having an extension for donning of said core thereon.

7. A lap winding apparatus as set forth in claim 1 further comprising a control device for moving said linear guide arrangement whereby a tensioning force on said belt decreases with an increasing diameter of a lap on said core.

8. A lap winding apparatus as set forth in claim 7 further comprising a sensor for directly scanning the diameter of the lap on said core and emitting a corresponding signal to said control device.

9. A lap winding apparatus as set forth in claim 7 wherein said control device is programmed to move said linear guide arrangement to decrease the tensioning force in said belt linearly as the diameter of the lap on said core increases until a predetermined lap diameter is reached.

10. A lap winding apparatus as set forth in claim 9 wherein said control device is programmed to maintain a constant tension in said belt after said predetermined lap diameter is reached.

11. A lap winding apparatus as set forth in claim 1 wherein said belt is looped over said tensioning roll over a wrapping angle of 180° during winding of a lap on said core.

12. A lap winding apparatus as set forth in claim 1 which further comprises a third deflecting roll rotatably mounted on a fixed axis and having said belt looped thereover in driving relation, said third deflecting roll having an axis of rotation in a plane of said rectilinear path of said linear guide arrangement.

13. A lap winding apparatus as set forth in claim 1 further comprising a feed guide for feeding a lap to between said belt and said core.

14. A lap winding apparatus as set forth in claim 1 further comprising a banana-shaped guide element adjacent one of said pair of deflecting rolls for guiding a lap to between said belt and said core.

15. A lap winding apparatus as set forth in claim 1 wherein said belt is made of a material selected from one of an aramid material and a polyamide material.

16. A lap winding apparatus comprising a core rotatably mounted on a fixed axis for winding of a lap thereon;

a pair of rotatable deflecting rolls parallel to said core;

an endless belt guided over said rolls and said core for driving said rolls and said core, said belt forming a loop between said rolls and about said core to effect winding of a lap onto said core;

a tensioning roll having said belt looped thereover, and a tensioning device for moving said tensioning roll between an extended position relative to said core and a retracted position relative to said core, said extended position corresponding to an initial position of said core without a lap thereon and said retracted position corresponding to a position of said core with a lap wound thereon.

17. A lap winding apparatus as set forth in claim 16 further comprising a control device for actuating said tensioning device whereby a tensioning force on a said belt decreases with an increasing diameter of a lap on said core.

18. A lap winding apparatus as set forth in claim 17 further comprising a sensor for directly scanning the diameter of the lap on said core and emitting a corresponding signal to said control device.

19. A lap winding apparatus as set forth in claim 17 wherein said control device is programmed to move said tensioning device to decrease the tensioning force in said belt linearly as the diameter of the lap on said core increases until a predetermined lap diameter is reached.

20. A lap winding apparatus as set forth in claim 19 wherein said control device is programmed to maintain a constant tension in said belt after said predetermined lap diameter is reached.

21. A lap winding apparatus as set forth in claim 16 wherein said belt is looped over said tensioning roll over a wrapping angle of 180° during winding of a lap on said core.

22. A lap winding apparatus as set forth in claim 16 which further comprises a third deflecting roll rotatably mounted on a fixed axis and having said belt looped thereover in driving relation.

23. A lap winding apparatus as set forth in claim 16 further comprising a control device for moving said tensioning device and a measuring device for measuring the batt length and supplying a signal representative of the lap diameter to said control device.

24. A lap winding apparatus as set forth in claim 16 wherein said tensioning device is driven by at least one of a hydraulic drive, an electrical drive and a pneumatic drive.

25. A lap winding apparatus as set forth in claim 16 wherein said tensioning device includes a piston and cylinder arrangement for moving said tensioning roll.

26. A lap winding apparatus as set forth in claim 16 further comprising a drive for driving at least one of said deflecting rolls and a control device connected to said drive to control the speed of said one deflecting roll to control the speed of the winding process.

27. A lap winding apparatus as set forth in claim 16 which further comprises a third deflecting roll rotatably mounted on a fixed axis and having said belt looped thereover in driving relation, and a pivoting arm pivotally connected to and between said third deflecting roll and one of said pair of deflecting rolls to pivot said one of said pair of deflecting rolls away from the other of said pair of deflecting rolls to permit removal of said core with a lap would thereon from between said pair of deflecting rolls.

28. A lap winding apparatus as set forth in claim 16 wherein said belt forms an initial wrapping angle about said core of at least 120°.

* * * * *

UNITED STATES PATENT AND TRADEMARK OFFICE

CERTIFICATE OF CORRECTION

PATENT NO. : 6,490,762 B1
DATED : December 10, 2002
INVENTOR(S) : Siegenthaler et al.

It is certified that error appears in the above-identified patent and that said Letters Patent is hereby corrected as shown below:

Column 1,
Line 4, after "producing a" insert -- lap --
Line 11, change "600" to -- 60º --
Line 17, change "baft" to -- at batt --
Line 19, change "baft" to -- batt --
Line 25, change "taps" to -- laps --
Line 46, change "baft" to -- batt --

Column 2,
Line 4, change "baft" to -- batt --
Line 52, change "baft" to -- batt --

Column 4,
Line 12, change "ills" to -- is --
Line 19, change "baft" to -- batt --
Line 19, change "1800" to -- 180º --
Line 26, change "bait" to -- batt --
Line 39, change "beginfling" to -- beginning --

Column 5,
Line 37, change "bait" to -- batt --

Column 7,
Line 15, change "215g" to -- 215º --

Signed and Sealed this

Fourth Day of March, 2003

JAMES E. ROGAN
*Director of the United States Patent and Trademark Office*